US007108615B2

(12) United States Patent
Kasashima et al.

(10) Patent No.: US 7,108,615 B2
(45) **Date of Patent: *Sep. 19, 2006**

(54) GOLF BALL

(75) Inventors: Atsuki Kasashima, Chichibu (JP); Katsunori Sato, Chichibu (JP); Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/915,712

(22) Filed: Aug. 11, 2004

(65) Prior Publication Data

US 2006/0035726 A1 Feb. 16, 2006

(51) Int. Cl.
*A63B 37/12* (2006.01)

(52) U.S. Cl. ..... 473/378

(58) Field of Classification Search ..... 473/378, 473/351, 368, 367
See application file for complete search history.

(56) References Cited

U.S. PATENT DOCUMENTS 4,869,512 A * 9/1989 Nomura et al. ..... 473/383
5,702,312 A * 12/1997 Horiuchi et al. ..... 473/377
2002/0183135 A1* 12/2002 Tsunoda et al. ..... 473/332

* cited by examiner

*Primary Examiner*—Raeann Gorden
(74) *Attorney, Agent, or Firm*—Sughrue Mion, PLLC

(57) ABSTRACT

A golf ball composed of an elastic solid core and a resin cover enclosing said core and having a number of dimples in the surface thereof, which is characterized in that said elastic solid core has resilience such that the deformation is 3.0 to 5.0 mm when the load is increased from 98 N (10 kgf) to 1275 N (130 kgf), said cover has a gage of 1.2 to 2.1 mm and a Shore D hardness of 60 to 75, and said dimples are formed in two or more different patterns, with their number amounting to 250 to 370. This golf ball is superior in flight performance.

19 Claims, 4 Drawing Sheets

GOLF BALL

BACKGROUND OF THE INVENTION

The present invention relates to a golf ball superior in flight performance.

There has been a desire that a solid golf ball should have a good feel on impact and an ability to stop quickly on the green. One way to attain this desire was to optimize the properties of the core and cover for the condition in which the golf ball experiences comparatively high spin (or backspin of about 3000 rpm induced by the driver shot).

However, the golf ball has recently been improved such that it increases its travel distance even when it is hit with low spin and at a high launch angle. The improvement in golf balls as well as clubs has changed the way of golf play. Now, it is not uncommon that the backspin induced by the driver (or any other clubs for a long carry) is less than 2000 rpm.

Under such a low spin condition, the golf ball experiences less coefficient of drag during flight and increases in carry. However, the golf ball with conventional dimples has the disadvantage that it gradually loses lift as it decreases in speed in the section of trajectory beyond the peak. The loss of lift leads to a decreased carry.

SUMMARY OF THE INVENTION

The present invention was completed in view of the foregoing. It is an object of the present invention to provide a golf ball which attains a long travel distance owing to its dimples and its structure and material combined together. The dimples are designed such that the golf ball retains it lift even though it has a low spin. The structure and material are intended to realize a low spin.

As the result of their comprehensive researches to achieve the above-mentioned object, the present inventors found that it is possible to increase carry further if the elastic solid core has hardness in an adequate range, the cover has gage and hardness in an adequate range, the ball surface has an adequate number of dimples in special pattern. These factors produce a synergistic effect. The present invention is based on this finding.

Thus, the present invention provides a golf ball as specified in the following.

(1) A golf ball composed of an elastic solid core and a resin cover enclosing said core and having a number of dimples in the surface thereof, which is characterized in that said elastic solid core has resilience such that the deformation is 3.0 to 5.0 mm when the load is increased from 98 N (10 kgf) to 1275 N (130 kgf), said cover has a gage of 1.2 to 2.1 mm and a Shore D hardness of 60 to 75, and said dimples are formed in two or more different patterns, with their number amounting to 250 to 370.

(2) The golf ball as defined in the first aspect, wherein said dimples are so formed as to satisfy the following equation.

$$\{(A-B)/A\}\times 100=1.1 \text{ to } 1.6\%$$

where, A denotes the hypothetical volume of the golf ball which is calculated on the assumption that the golf ball is a true sphere without dimples in its surface, and B denotes the actual volume of the golf ball.

(3) The golf ball as defined in the first or second aspect, wherein said dimples each are circular in plan view.

(4) The golf ball as defined in the first or second aspect, wherein said dimples each are non-circular in plan view.

(5) The golf ball as defined in the first or second aspect, wherein said dimples each are both circular in plan view and non-circular in plan view in combination.

(6) The golf ball as defined in the fourth aspect, wherein said dimples each are divided by edges whose cross sections are formed almost uniform.

(7) The golf ball as defined in the first aspect, wherein said resin cover is formed from a resin compound containing organic short fibers dispersed therein.

(8) The golf ball as defined in the first or second aspect, wherein said resin cover is formed from a resin compound which is composed of (a) at least one component selected from olefin-unsaturated carboxylic acid copolymer, olefin-unsaturated carboxylic acid-unsaturated carboxylate ester copolymer, and ion-neutralized products of these copolymers, and (b) a binary copolymer composed of a polyolefin component and a polyamide component.

(9) The golf ball as defined in the eighth aspect, wherein said polyamide in the component (b) is in fibrous form.

(10) The golf ball as defined in the first aspect, which, after being hit, produces an aerodynamic effect such that the coefficient of lift (CL) at a Reynolds number of 70000 and a spin of 2000 rpm is larger than 70% of that at a Reynolds number of 80000 and a spin of 2000 rpm, and the coefficient of drag (CD) at a Reynolds number of 180000 and a spin of 2520 rpm is not greater than 0.225.

DETAILED DESCRIPTION OF THE PREFERRED EMBODIMENTS

The invention will be described in more detail with reference to the accompanying drawings.

Figure 1:
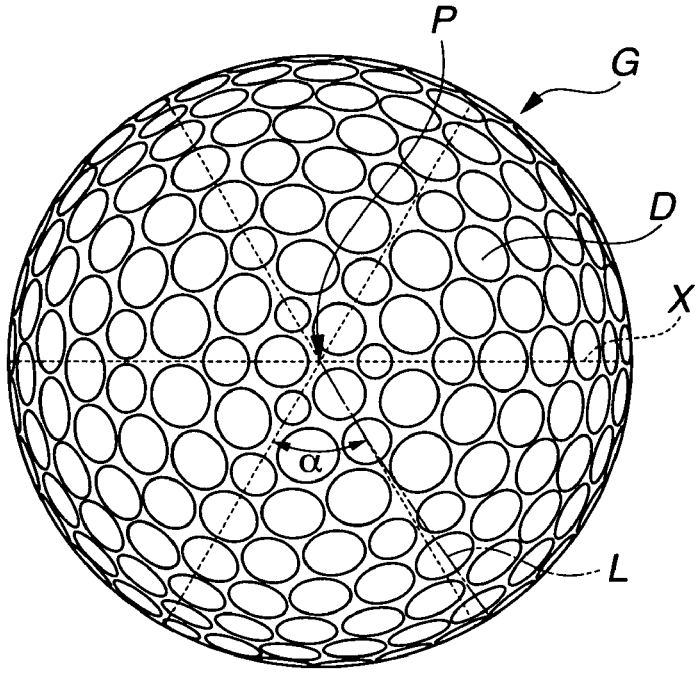
FIG. 1 is a plan view showing the golf ball pertaining to the first embodiment of the present invention.
Figure 2:
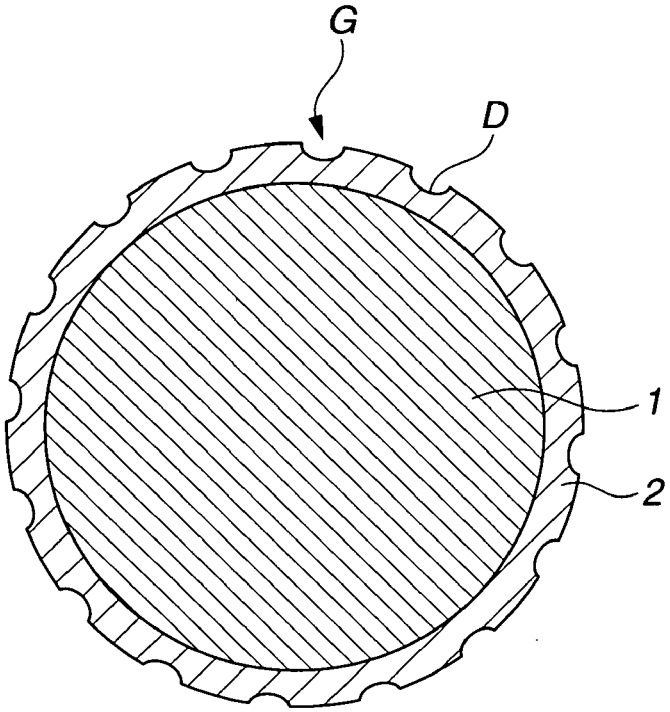
FIG. 2 is a sectional view showing the internal structure (double-layer structure) of the golf ball pertaining to the first embodiment of the present invention.

FIGS. 1 and 2 are a plan view and a sectional view, respectively, showing the golf ball pertaining to the first embodiment of the present invention.

It is noted from FIGS. 1 and 2 that the golf ball according to the present invention is made up of an elastic solid core and a cover of thermoplastic resin enclosing said core. There may optionally be interposed between the core and cover one or more intermediate layers differing in hardness and other properties:

According to the present invention, the elastic solid core has resilience such that the deformation is 3.0 to 5.0 mm when the load is increased from 98 N (10 kgf) to 1275 N (130 kgf), the cover has a gage of 1.2 to 2.1 mm and a Shore D hardness of 60 to 75, and the dimples are formed in two or more different patterns, with their number amounting to 250 to 370.

It is generally known that the golf ball easily gains a large initial velocity after hitting as the core becomes harder. But it is also known that the golf ball increases in spin as the core becomes harder. In view of the trade-off between initial velocity and spin, the solid core should have resilience such that the deformation is 3.0 to 5.0 mm, preferably 3.4 to 4.0 mm, when the load is increased from 10 kgf to 130 kgf.

On the other hand, the cover should have a gage of 1.2 to 2.1 mm, preferably 1.4 to 1.8 mm, from the standpoint of durability and feel on impact. Moreover, the cover should have a Shore D hardness of 60 to 75, preferably 63 to 68, so that it produces the desired performance in concert with the core.

According to the present invention, the golf ball has dimples formed in the surface thereof. The dimples which are different from one another in diameter and/or depth are included. The number of dimples amounts to 250 to 370. The edge (or outline) of each dimple should preferably have a length of 12.56 to 20.00 mm.

The golf ball pertaining to the first embodiment shown in FIG. 1 has 330 circular dimples with six varied diameters, ranging from 2.6 to 4.6 mm. The surface of the golf ball can be covered evenly with at least four kinds of dimples varying in diameter. The kind of the dimple is not specifically restricted. Dimples can be arranged in conformity with a polyhedra consisting of polygonal unit planes (such as triangles and pentagons). Incidentally, it is possible that all the dimples slightly differ in diameter from one another. In this case there may be more than 20 kinds of dimples. Dimples should preferably be formed in such a way that the area of dimples in plan view accounts for equal to or more than 78% of the spherical surface of the golf ball. Moreover, the dimples should be so formed and arranged three-dimensionally as to satisfy the following equation.

$$\{(A-B)/A\}\times 100=1.1 \text{ to } 1.6\% \text{ (preferably 1.2 to 1.5\%)}$$

where, A denotes the hypothetical volume of the golf ball which is calculated on the assumption that the golf ball is a true sphere without dimples in its surface, and B denotes the actual volume of the golf ball.

With this ratio smaller than 1.1%, the golf ball tends to fly high when hit. With this ratio larger than 1.6%, the golf ball tends to fly low and lose velocity.

The above-mentioned cover may be formed mainly from a hard thermoplastic resin, such as ionomer and polyurethane.

The golf ball pertaining to the first embodiment shown in FIG. 1 has dimples arranged in the following manner.

The golf ball G shown in FIG. 1 is divided into six spherical triangles by six reference lines X (dotted lines) passing through the pole P (the north pole for convenience) and intersecting with one another at an angle ($\alpha$) of 60° and crossing with the equator (not shown) at right angles. Each spherical triangle surrounded by the reference lines X and the equator constitutes a unit in which the dimples D are arranged. Therefore, at the boundary between adjacent triangles, dimples are symmetrical with respect to the boundary line. The foregoing basic arrangement is slightly changed as follows. Those dimples in the region ranging from the third dimple (counting from the north pole P) to the equator are slightly displaced in the counterclockwise direction in such a way that the dimples closest to the equator are displaced most. (This displacement is indicated by the one-dot chain line L passing through the centers of the dimples.) The same dimple arrangement as mentioned above is also applied to the other half sphere with the north pole (not shown). Thus, those dimples in the region ranging from the third dimple (counting from the south pole) to the equator are slightly displaced in the clockwise direction in such a way that the dimples closest to the equator are displaced most. As the result, all the dimples in the northern hemisphere are substantially symmetric to all the dimples in the southern hemisphere with respect to the center of the golf ball G.

In the above-mentioned embodiment, the dimples D closest to the equator in the northern hemisphere are displaced relative to the dimples closest to the equator in the southern hemisphere. The amount of displacement is approximately equal to half the size of one dimple. Consequently, those dimples which are closest to the equator and which are arranged in the northern and southern hemispheres along the equator are staggered to each other in the circumferential direction.

Figure 3:
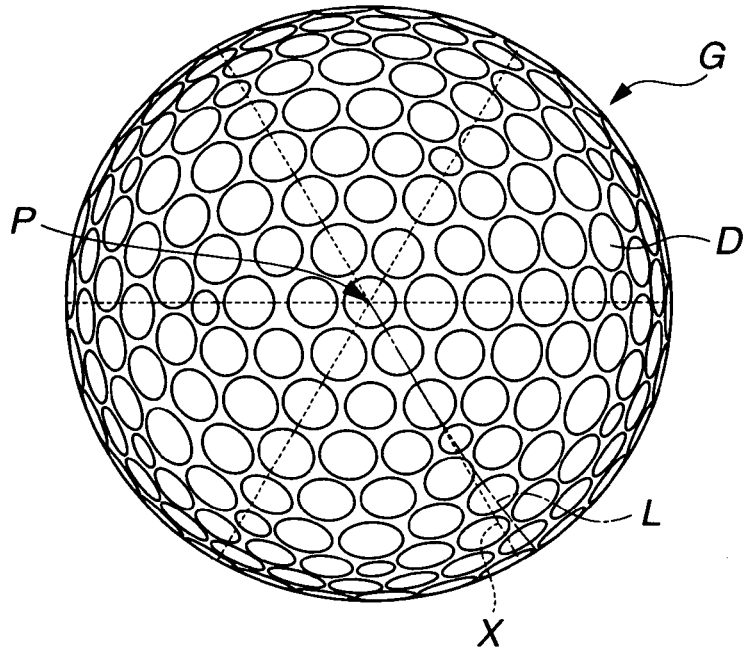
FIG. 3 is a plan view showing the golf ball pertaining to the second embodiment of the present invention.

FIG. 3 is a plan view of the golf ball G pertaining to the second embodiment of the present invention. The dimple arrangement of this golf ball is identical with that of the golf ball in the first embodiment, except that the dimples are circular with six different diameters ranging from 2.65 mm to 4.60 mm and the number of dimples amounts to 344.

Figure 4:
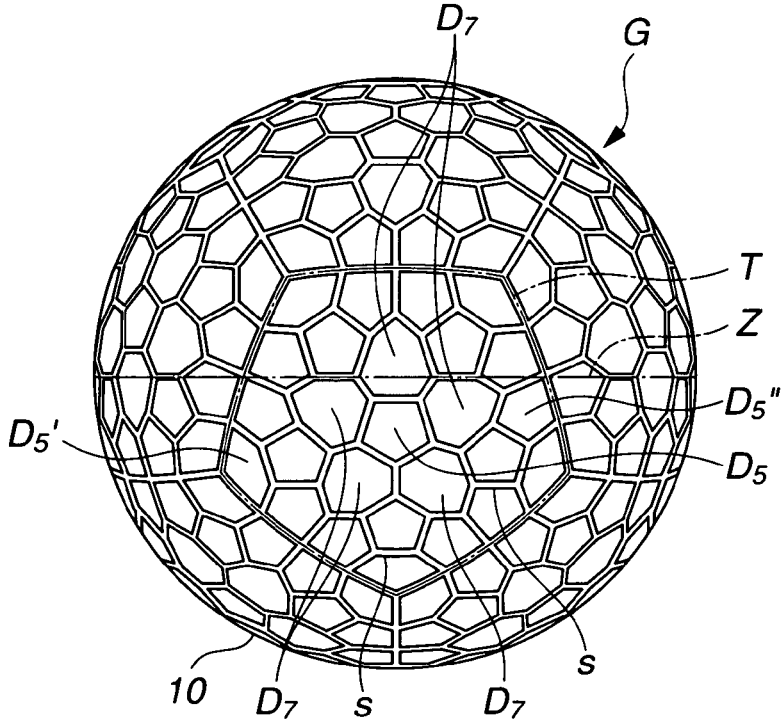
FIG. 4 is a plan view showing the golf ball pertaining to the third embodiment of the present invention.
Figure 5:
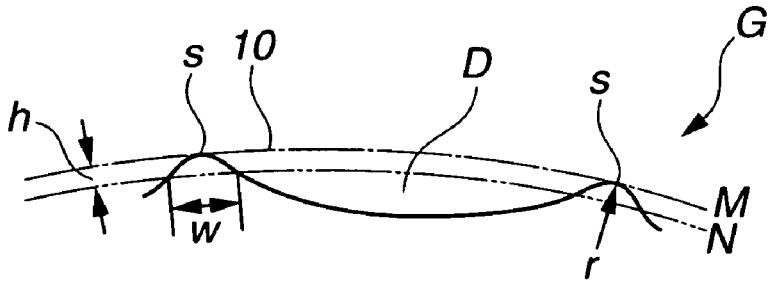
FIG. 5 is a diagram showing the structure of a dimple formed in the surface of the golf ball shown in FIG. 4.

FIG. 4 is a plan view showing the golf ball pertaining to the third embodiment of the present invention. FIG. 5 is a diagram showing the cross-section of a dimple formed in the surface of the golf ball shown in FIG. 4.

The golf ball pertaining to the third embodiment has polygonal dimples evenly arranged over the entire surface of the sphere. Each polygonal dimple is surrounded by linear edges s. Specifically speaking, the golf ball is regarded as a dodecahedron, and one pentagon T out of 12 is indicated by chain lines. In this unit pentagon are evenly arranged 26 dimples D, varying in size and shape (mostly pentagons). The dimples D are arranged as follows. At the center of the unit pentagon T is placed a pentagonal dimple $D_5$ which is substantially similar to the unit pentagon T. The dimple $D_5$ is surrounded by edges s, which are parallel to their corresponding sides of the unit pentagon T. (The dimple $D_5$ is referred to as the central dimple hereinafter.) Around the central dimple are arranged five heptagonal dimples $G_7$ like petals. At each vertex (or corner) of the unit pentagon T is placed a pentagonal dimple $D_5'$, which inscribes the sides of the unit pentagon T. Between the pentagonal dimple $D_5'$ and the two heptagonal dimples $D_7$ are evenly arranged other three pentagonal dimples $D_5''$. Consequently, 21 pentagonal dimples ($D_5$, $D_5'$, $D_5''$) and 5 heptagonal dimples $D_7$ (26 in total) are arranged within one unit pentagon T. Thus, there are 312 dimples (pentagonal and heptagonal) over the entire surface of the golf ball 10.

In the third embodiment, the edge s is formed as shown in FIG. 5. That is, the edge s is formed in the region between the one-dot chain line (M) and the two-dot chain line (N). M denotes the outer surface of the golf ball, and N denotes the reference line which is a distance h inward from M.

The edge s has a convex section with a curvature radius r. If the dimple D is concave as shown in FIG. 5, the inflection point of the dimple D and the edge s is at the position through which the reference line N passes. The edge s has a width w, which is measured at the base on the reference line N shown in FIG. 5. (This applies to the edges extending parallel to each other, shown in FIG. 4.) Incidentally, in this embodiment, the mutually adjacent polygonal dimples D jointly own the edge s between them. All the edges s have substantially the same sectional structure except for those close to the equator or those at their intersections.

Figure 6:
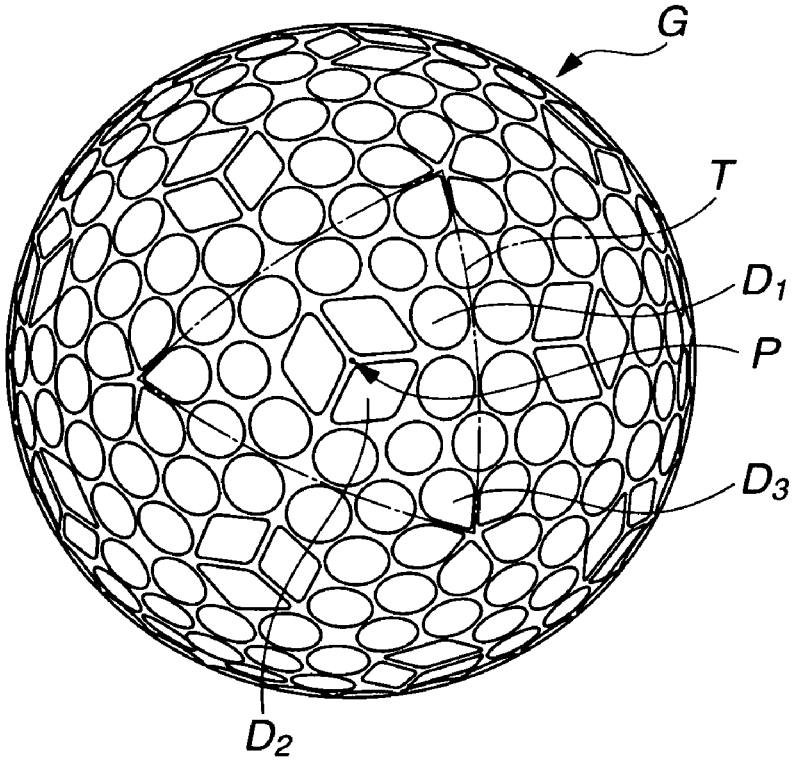
FIG. 6 is a plan view showing the golf ball pertaining to the fourth embodiment of the present invention.

FIG. 6 is a plan view showing the golf ball pertaining to the fourth embodiment of the present invention.

In this embodiment, the dimple arrangement is based on the spherical icosahedron. The golf ball shown in FIG. 6 has one unit regular triangle T indicated by a one-dot chain line for convenience. The unit regular triangle T is arranged such that its center coincides with the pole P of the golf ball.

In the vicinity of each vertex of the unit regular triangle T are arranged three dew drop-shaped (non-circular) dimples $D_3$. At the center of the unit regular triangle T are arranged three rhombic (non-circular) dimples $D_2$, which are slightly larger than the dew drop-shaped dimples $D_3$. In the remaining area of the unit regular triangle T are arranged two kinds of nine circular dimples $D_1$ differing in diameter. Moreover, on each side of the unit regular triangle T are arranged two circular dimples $D_1$ such that their centers coincide with each side. In this case, there are four kinds of dimples, circular and non-circular.

As mentioned above, the golf ball according to the present invention may have dimples in any shape (circular, polygonal, dew drop, elliptic, etc.) so long as they do not hinder the object of the present invention.

The golf ball according to the present invention should have an elastic core which is formed from a rubber compound containing any known co-cross-linking agent, organic peroxide, inert filler, organic sulfur compound, etc. The base material of the rubber compound should preferably be polybutadiene.

In addition, the golf ball according to the present invention should have a resin cover which is formed from any known compound of synthetic resin without specific restrictions. To be concrete, preferred ones are those of hard thermoplastic resin, such as ionomer resin and polyurethane resin.

The resin compound for the resin cover should preferably contain organic short fibers dispersed therein.

The resin compound for the resin cover should preferably be composed of (a) at least one component selected from olefin-unsaturated carboxylic acid copolymer, olefin-unsaturated carboxylic acid-unsaturated carboxylate ester copolymer, and ion-neutralized products of these copolymers, and (b) a binary copolymer composed of a polyolefin component and a polyamide component. The components (a) and (b) will be described below in more detail.

The component (a) is selected from the following:

Binary random copolymer composed of an olefin and an unsaturated carboxylic acid;

ion-neutralized products of a binary random copolymer composed of an olefin and an unsaturated carboxylic acid;

Ternary random copolymer composed of an olefin, an unsaturated carboxylic acid, and an ester of unsaturated carboxylic acid;

ion-neutralized products of a ternary random copolymer composed of an olefin, an unsaturated carboxylic acid, and an ester of unsaturated carboxylic acid.

The olefin in the copolymer should preferably be one which has a carbon number of 2 or above and 8 or less, particularly 6 or less. Its typical examples include ethylene, propylene, butene, pentene, hexene, heptene, and octane, with ethylene being preferable.

The unsaturated carboxylic acid includes, for example, acrylic acid, methacrylic acid, maleic acid, and fumaric acid, with the former two being preferable.

The ester of unsaturated carboxylic acid should preferably be a lower alkyl ester of the unsaturated carboxylic acid mentioned above. Its typical examples include methyl methacrylate, ethyl methacrylate, propyl methacrylate, butyl methacrylate, methyl acrylate, ethyl acrylate, propyl acrylate, and butyl acrylate. Of these examples, butyl acrylate (n-butyl acrylate and i-butyl acrylate) are preferable.

The olefin component in the component (b) may be any of low-density polyethylene (LDPE), high-density polyethylene (HDPE), polypropylene, polystyrene, and the like. Of these olefin polymers, polyethylene, particularly highly crystalline low-density polyethylene, is preferable.

The polyamide component may be selected from nylon 6, nylon 66, nylon 11, nylon 12, nylon 610, nylon 612, nylon copolymer, nylon MXD6, nylon 46, aramid, polyamide-imide, polyimide, and the like. Nylon 6 is preferable because of its properties balanced with price. The polyamide component should preferably be in fibrous form. The nylon fiber as the polyamide component should have an average diameter no larger than 10 μm, preferably no larger than 5 μm, and most desirably no larger than 1 μm. However, the average diameter should be equal to or larger than 0.01 μm so that the nylon fiber produces the maximum reinforcing effect with a minimum amount. Incidentally, the average diameter is measured by observing a cross section of a sample under a transmission electron microscope.

According to the present invention, the component (b) should preferably be composed of a crystalline polyolefin and nylon fibers dispersed therein such that the polyolefin binds to the surface of the nylon fibers. The term "bind" means that the polyolefin grafts on the polyamide with the help of a binder, such as silane coupling agent, titanate coupling agent, unsaturated carboxylic acid (and its derivatives), and organic peroxide.

The component (b) should be composed of the polyolefin component (b-1) and the polyamide component (b-2) in a weight ratio of (b-1)/(b-2)=from 25/75 to 95/5, preferably from 30/70 to 90/10, and more preferably from 40/60 to 75/25. Insufficient polyamide does not fully produce the reinforcing effect. Excess polyamide presents difficulties in mixing with the component (a) by a twin-screw extruder or the like.

The mixing ratio (by weight) of the component (a) and the component (b) should be (a)/(b)=from 100/0.1 to 100/50, preferably from 100/1 to 100/40, and more preferably from 100/2 to 100/30. The component (b) in an insufficient amount does not fully produce the reinforcing effect. The component (b) in an excess amount presents difficulties in mixing or molding (to form the golf ball cover).

The golf ball of the present invention receives various forces during its flight as explained in the following.

For a ball hit with a wood club #1 (or driver) to achieve a long carry without being affected by wind and to achieve a long run, it is necessary that the ball experience adequately balanced lift and drag which depend not only on the ball's structure and material but also on the ball's dimples (shape, number, surface coverage, and total volume).

Figure 7:
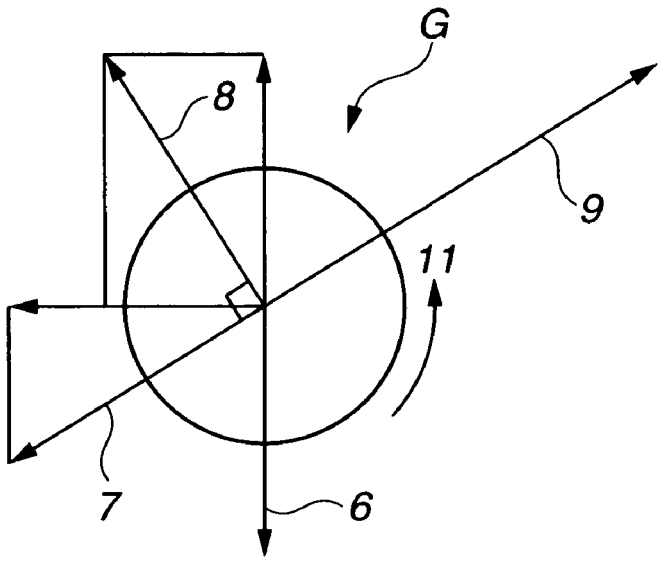
FIG. 7 is a diagram showing the relation between the lift and drag which the golf ball experiences during flight.

It is known that a hit ball G in flight experiences gravitational force 6, air resistance (drag) 7, and lift 8 (due to Magnus effect produced by ball spinning), as shown in FIG. 7. Incidentally, reference numerals 9 to 11 in FIG. 7 indicate respectively the direction of flight, the center of the ball, and the direction of spinning of the ball G.

The forces acting on the golf ball under this condition are expressed by the trajectory equation (1) below.

$$F=FL+FD+Mg \quad (1)$$

where, F: forces acting on the golf ball
FL: lift
FD: drag
Mg: gravity

Also, the lift FL and drag FD in the trajectory equation (1) above are given by the following formulas (2) and (3).

$$FL=0.5\times CL\times\rho\times A\times V^2 \quad (2)$$

$$FD=0.5\times CD\times\rho\times A\times V^2 \quad (3)$$

where, CL: coefficient of lift
CD: coefficient of drag
ρ: density of air
A: maximum sectional area of golf ball
V: velocity of air relative to golf ball Merely decreasing the drag or the coefficient of drag (CD) is not so effective in increasing the carry. A golf ball with a reduced coefficient of drag increases in the distance at which the ball reaches the highest point; however, it rapidly drops due to insufficient lift in the low-speed region after it has passed the highest point. The result is a shorter carry than expected.

The golf ball of the present invention should preferably have the properties as specified below:

The coefficient of drag (CD) should be no larger than 0.225 if the Reynolds number is 180000 and the spin is 2520 rpm immediately after the ball has been hit;

The coefficient of lift (CL) at a Raynolds number of 70000 and a spin of 2000 rpm which is immediately before the hit ball reaches the highest point of the trajectory should remain equal to or larger than 70% of that at a Raynolds number of 80000 and a spin of 2000 rpm.

Incidentally, the Reynolds number of 180000 immediately after hitting corresponds to a ball velocity of about 65 m/s, and the Reynolds numbers of 80000 and 70000 correspond to about 30 m/s and about 27 m/s, respectively.

The golf ball of the present invention is not restricted in other respects so long as the above-mentioned requirements are met. It may be of two-piece structure or multi-piece structure (with three or more layers) of a solid golf ball. The diameter and weight of the golf ball should be properly established according to the rules. Usually, the diameter should be no smaller than 42.67 mm, and the weight should be no more than 45.93 g.

EXAMPLES

The present invention will be described in more detail with reference to the following examples and comparative examples, which are not intended to restrict the scope thereof.

Examples 1 to 4 and Comparative Example 1

A two-piece solid golf ball (of double-layer structure as shown in FIG. 2) was prepared. The core of the golf ball was formed from the rubber compound shown in Table 1. The cover of the golf ball was formed from the resin compound shown in Table 2. The golf ball in each example had dimples arranged as shown in FIGS. 1, 3, 4, 6, and 8 for Examples 1, 2, 3, and 4, and Comparative Example 1, respectively.

The golf ball in Comparative Example 1 had 432 circular dimples with five different diameters, ranging from 2.38 mm to 3.89 mm, which are evenly arranged in conformity with an icosahedron. The golf ball in each example was tested for flight performance in the following manner. The results are shown in Table 3.

TABLE 1

| | | Example | | | | Comparative Example |
|---|---|---|---|---|---|---|
| | | 1 | 2 | 3 | 4 | 1 |
| Formulation for core (pbw) | Polybutadiene *1 | 100 | 100 | 100 | 100 | 100 |
| | Zinc acrylate | 26.0 | 25.0 | 26.0 | 26.0 | 26.0 |
| | Organic peroxide (1) *2 | 0.6 | 0.6 | 0.6 | 0.6 | 0.6 |
| | Organic peroxide (2) *3 | 0.6 | 0.6 | 0.6 | 0.6 | 0.6 |
| | Antioxidant *4 | 0.2 | 0.2 | 0.2 | 0.2 | 0.2 |
| | Zinc oxide | 5 | 5 | 5 | 5 | 5 |
| | Barium sulfate | 17.4 | 17.8 | 17.4 | 17.4 | 17.4 |
| Vulcanization (temperature × duration) | | 157° C. 15 minutes | 157° C. 15 minutes | 157° C. 15 minutes | 157° C. 15 minutes | 157° C. 15 minutes |

Note:
*1 BR01 (from JSR)
*2 Dicumyl peroxide, "Percumyl D" (from NOF Corp.)
*3 1,1-bis(t-butylperoxy)3,3,5-trimethylcyclohexane, "Perhexa 3M-40" (from NOF Corp.)
*4 "Nocrac NS-6" (from Ouchishinko Chemical Industrial Co., Ltd.)

TABLE 2

| | Example | | | | Comparative Example |
|---|---|---|---|---|---|
| Component (pbw) | 1 | 2 | 3 | 4 | 1 |
| "Himilan AM7317" *1 | 50 | | 50 | 50 | 50 |
| "Himilan AM7318" *1 | 50 | | | | 50 |
| "Himilan AM7315" *1 | | 50 | | | |
| "Surlyn 8220" *2 | | 50 | | | |
| "Himilan 1605" *3 | | | 50 | 50 | |
| Polyolefin/polyamide binary copolymer *4 | | | 5 | 5 | |
| Titanium oxide | 2 | 2 | 2 | 2 | 2 |
| Magnesium stearate | 1 | 1 | 1 | 1 | 1 |

Note:
*1 Ionomer resin from Mitsui-DuPont Chemical
*2 Ionomer resin from DuPont
*3 Ionomer resin from Mitsui-DuPont Chemical
*4 "LA0010" from Daiwa Polymer, composed of 100 pbw of polyolefin (low-density polyethylene) and 100 pbw of polyamide (nylon 6) short fibers.

Flight Performance

For evaluation of carry, each golf ball was hit at a head speed of 45 m/s by means of a hitting robot equipped with a club.

TABLE 3

Figure 8:
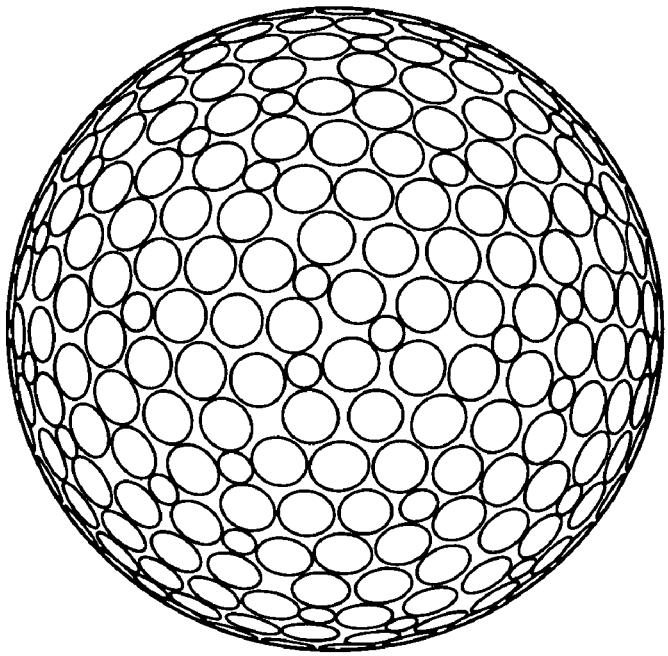
FIG. 8 is a plan view of the golf ball for comparison.

| | | Example | | | | Comparative Example |
|---|---|---|---|---|---|---|
| | | 1 | 2 | 3 | 4 | 1 |
| Arrangement of dimples | | FIG. 1 | FIG. 3 | FIG. 4 | FIG. 6 | FIG. 8 |
| Total number of dimples | | 330 | 344 | 312 | 360 | 432 |
| Thickness of cover (mm) | | 1.7 | 1.7 | 1.7 | 1.7 | 1.7 |
| Shore D hardness of cover | | 65 | 67 | 64 | 64 | 65 |
| Deformation of core (mm) *1 | | 3.4 | 3.2 | 3.4 | 3.4 | 3.4 |
| Ratio of volume of dimples *2 | | 1.35 | 1.34 | 1.52 | 1.28 | 1.25 |
| Ratio of CL at low speed *3 | | 82 | 83 | 85 | 80 | 65 |
| Value of CD at high speed *4 | | 0.214 | 0.213 | 0.215 | 0.219 | 0.215 |
| Flight Distance | Carry (m) | 225 | 225 | 223 | 223 | 220 |
| | Total (m) | 244 | 245 | 243 | 243 | 241 |

Note:

*1 Deformation that occurs when the load applied to the core (placed on a hard board) is increased from 98 N (10 kgf) to 1275 N (130 kgf).

*2 The value calculated from the following equation. $\{(A - B)/A\} \times 100 = 1.1$ to 1.6% where, A denotes the hypothetical volume of the golf ball which is calculated on the assumption that the golf ball is a true sphere without dimples in its surface, and B denotes the actual volume of the golf ball.

*3 The ratio of the coefficient of lift at a Reynolds number of 70000 and a spin of 2000 rpm to the coefficient of lift at a Reynolds number of 80000 and a spin of 2000 rpm, for the golf ball hit at an initial velocity of 65 m/s by means of a hitting robot.

*4 The value of the coefficient of drag measured immediately after hitting at a Reynolds number of 180000 and a spin of 2520 rpm.

The invention claimed is:

1. A golf ball composed of an elastic solid core and a resin cover enclosing said core and having a number of dimples in the surface thereof, which is characterized in that said elastic solid core has resilience such that the deformation is 3.0 to 5.0 mm when the load is increased from 98 N (10 kgf) to 1275 N (130 kgf), said cover has a gage of 1.2 to 2.1 mm and a Shore D hardness of 60 to 75, and said dimples two or more different patterns, with their number amounting to 250 to 370, and wherein said dimples are so formed as to satisfy the following equation:

$$\{(A-B)/A\}\times 100=1.1 \text{ to } 1.6\%$$

where, A denotes the hypothetical volume of the golf ball which is calculated on the assumption that the golf ball is a true sphere without dimples in its surface, and B denotes the actual volume of the golf ball.

2. The golf ball as defined in claim 1, wherein said dimples each are circular in plan view.

3. The golf ball as defined in claim 1, wherein said dimples each are non-circular in plan view.

4. The golf ball as defined in claim 1, wherein said dimples each are both circular in plan view and non-circular in plan view in combination.

5. The golf ball as defined in claim 3, wherein said dimples each are divided by edges whose cross sections are formed almost uniform.

6. The golf ball as defined in claim 1, wherein said resin cover is formed from a resin compound containing organic short fibers dispersed therein.

7. A golf ball composed of an elastic solid core and a resin cover enclosing said core and having a number of dimples in the surface thereof, which is characterized in that said elastic solid core has resilience such that the deformation is 3.0 to 5.0 mm when the load is increased from 98 N (10 kgf) to 1275 N (130 kgf), said cover has a gage of 1.2 to 2.1 mm and a Shore D hardness of 60 to 75, and said dimples have two or more different patterns, with their number amounting to 250 to 370, wherein said resin cover is formed from a resin compound which is composed of (a) at least one component selected from olefin-unsaturated carboxylic acid copolymer, olefin-unsaturated carboxylic acid-unsaturated carboxylate ester copolymer, and ion-neutralized products of these copolymers, and (b) a binary copolymer composed of a polyolefin component and a polyamide component.

8. The golf ball as defined in claim 7, wherein said polyamide in the component (b) is in fibrous form.

9. The golf ball as defined in claim 7, wherein said dimples each are circular in plan view.

10. The golf ball as defined in claim 7, wherein said dimples each are non-circular in plan view.

11. The golf ball as defined in claim 7, wherein said dimples each are both circular in plan view and non-circular in plan view in combination.

12. The golf ball as defined in claim 10, wherein said dimples each are divided by edges whose cross sections are formed almost uniform.

13. The golf ball as defined in claim 7, wherein said resin contains organic short fibers dispersed therein.

14. A golf ball composed of an elastic solid core and a resin cover enclosing said core and having a number of dimples in the surface thereof, which is characterized in that said elastic solid core has resilience such that the deformation is 3.0 to 5.0 mm when the load is increased from 98 N (10 kgf) to 1275 N (130 kgf), said cover has a gage of 1.2 to 2.1 mm and a Shore D hardness of 60 to 75, and said dimples have two or more different patterns, with their number amounting to 250 to 370, wherein the golf ball, after being hit, produces an aerodynamic effect such that the coefficient of lift (CL) at a Reynolds number of 70000 and a spin of 2000 rpm is larger than 70% of that at a Reynolds number of 80000 and a spin of 2000 rpm, and the coefficient of drag (CD)

at a Reynolds number of 180000 and a spin of 2520 rpm is not greater than 0.225.

15. The golf ball as defined in claim 14, wherein said dimples each are circular in plan view.

16. The golf ball as defined in claim 14, wherein said dimples each are non-circular in plan view.

17. The golf ball as defined in claim 14, wherein said dimples each are both circular in plan view and non-circular in plan view in combination.

18. The golf ball as defined in claim 16, wherein said dimples each are divided by edges whose cross sections are formed almost uniform.

19. The golf ball as defined in claim 14, wherein said resin cover is formed from a resin compound containing organic short fibers dispersed therein.

* * * * *

UNITED STATES PATENT AND TRADEMARK OFFICE

CERTIFICATE OF CORRECTION

PATENT NO. : 7,108,615 B2
APPLICATION NO. : 10/915712
DATED : September 19, 2006
INVENTOR(S) : Atsuki Kasashima, Katsunori Sato and Hideo Watanabe It is certified that error appears in the above-identified patent and that said Letters Patent is hereby corrected as shown below:

**Please correct column 9, Table 3, Note *3 as follows:**

*3 The ratio of the coefficient of lift at a Reynolds number of 70000 and a spin of 2000 rpm to the coefficient of lift at a Reynolds number of 80000 and a spin of 2000 rpm.

Signed and Sealed this

First Day of January, 2008

JON W. DUDAS
*Director of the United States Patent and Trademark Office*